US006315500B1

(12) United States Patent
Goodman et al.

(10) Patent No.: US 6,315,500 B1
(45) Date of Patent: Nov. 13, 2001

(54) GROUND WATERING SPRAY SYSTEM FOR BACKHOE MACHINES

(76) Inventors: Tim Goodman, 810 N. Johnson; Brent Mehlenbacher, 37133 S. Owens Rd., both of Kennewick, WA (US) 99337

( * ) Notice: Subject to any disclaimer, the term of this patent is extended or adjusted under 35 U.S.C. 154(b) by 0 days.

(21) Appl. No.: 09/415,897

(22) Filed: Oct. 8, 1999

(51) Int. Cl.[7] ..... E02D 3/026

(52) U.S. Cl. ..... 405/271; 405/128.15; 405/129.15; 37/443; 37/444

(58) Field of Search ..... 405/258, 271, 405/303, 128.1, 128.15, 129.1, 129.15; 37/443, 444; 404/117

(56) References Cited

U.S. PATENT DOCUMENTS

| | | | | |
|---|---|---|---|---|
| 1,729,573 | | 9/1929 | Finley | 366/345 |
| 4,070,064 | | 1/1978 | Cobb | 299/81.1 |
| 4,224,003 | | 9/1980 | Louis | 404/133.2 |
| 4,397,590 | * | 8/1983 | Friesen et al. | 405/271 |
| 4,943,165 | | 7/1990 | Boggs | 366/348 |
| 4,981,396 | * | 1/1991 | Albertson et al. | 405/178 |

* cited by examiner

*Primary Examiner*—David Bagnell
*Assistant Examiner*—Tara L. Mayo

(57) ABSTRACT

A watering spray system offering a method for softening soil in preparation for compacting the soil with a vibrating compactor attached to the end of an articulated arm of a backhoe, or the like equipment. The system includes a water spray head secured to the end of the articulated arm of the backhoe in full view of the backhoe operator to apply water for moisturizing back fill soil for compacting, a shut-off valve for controlling the water applied, a flexible water supply line starting at the water supply tank, running under the backhoe cab, and along the articulated main boom and arm, ending at the spray head. A welded frame assembly positioned at the rear of the backhoe, for suspending the flexible water supply hose above the backhoe motor for viewing by backhoe operator to determine tension on the hose, preventing over-stretching and possible damage to the conduit during operation. The source of water may vary to maintain sufficient pressure at the spray head. The Invention allows the backhoe operator sitting in the cab to control the application of water for dampening soil in the preparation for compacting. Application of water is controlled by an electrical switch, located within the cab, used to energize the electric-water-flow-control-valve to the open or close position. The backhoe spray system is also used for cleaning large surface areas which have been contaminated by toxic substances, such as oil, gasoline, and the like liquids.

14 Claims, 10 Drawing Sheets

GROUND WATERING SPRAY SYSTEM FOR BACKHOE MACHINES

CROSS-REFERENCE TO RELATED APPLICATIONS

Not applicable

1. BACKGROUND—Field of Invention

This invention relates to a liquid spray system used to soften soil with water in the preparation for compacting, and to clean large ground surfaces areas which have been contaminated by toxic chemicals with high pressure and temperature liquids, as applied to a backhoe or the like machines operated and controlled by a single operator.

2. BACKGROUND—Description of Prior Art

A backhoe or the like machine comes in various sizes and is used to excavate deep trenches, to lay down sewer pipes, water pipes, electrical cable and many other types of underground accouterments. It is also used to remove large amounts of earth from a work site to prepare the earth's surface for construction and road building, and, in addition, it is also used to back fill the excavated trenches and holes after the pipes and accouterments are lain in the trenches.

After the pipes and various accouterments are in place, the trenches are filled with backfill soil, and a vibrating earth compactor attached to end joint of the backhoe arm is used to compact the back fill soil to specified soil density requirement. To achieve this requirement, water is applied to soften the back fill soil, thus enhancing the compaction.

Our Invention relates directly to applying the water to soften the soil in order to enhance the compactness of the soil. PRIOR ART required that a number of workers be standing around the backhoe, or like machine, with hoses to apply water to the soil at various locations at the direction of the backhoe operator who is sitting in the cab and operating the machine, as well as, at the same time, directing the workers holding water hoses around the working area. Because of the loud machine noise of the backhoe, hand signals are used by the backhoe operator to direct the workers where best to apply the water.

Our Invention obviates the necessity for workers to be employed in the above-described tasks. It allows the backhoe operator to apply and control the water spray to the fill soil as needed, while still operating the backhoe. Our Invention configures to all sizes of backhoes or the like machines, as well as other earth moving equipment where spray water is required.

Our discussion and criticism of the relevant prior art, is based on our hands-on experience with a backhoe soil compactor attachment, and the soil watering methods presently used in the industry.

Typically, a backhoe operator attaches a vibratory soil compactor to the jig boom extension arm of the backhoe to compact the back fill soil, which is used to cover a trench after the underground accouterments are lain into position. The soil is loose and must be compacted to acceptable soil density compact standards required by various construction specifications. To achieve the density standards, the soil must be wetted down with water to a workable consistency as the backhoe operator, in his cab, applies the vibratory soil compactor to the loose soil. Workers, with water hoses, positioned around the backhoe machine, are directed by the operator, in the cab of the backhoe, to apply water to the soil during the time that the backhoe machine is in full operation.

During the operation of the backhoe, the operator will manipulate the backhoe boom arm forward, backwards or will swing the boom arm 360° degrees in either direction to reach areas where the soil must be compacted.

This manipulation of the backhoe is conducted within the path of the workers holding water hoses to wet the soil, thus creating a severe safety hazard to the workers as they are in harm's way of the boom arm. Consequently, as it is imperative for the operator to view the workers from his position in the cab of the backhoe, it becomes difficult for the operator to clearly see all the workers surrounding the backhoe machine, thus further jeopardizing the safety of the workers.

The low efficiency of this operation, and the additional manpower required, in having workers stand around the backhoe applying water by hand to the soil, is not only dangerous and unsafe, but is not cost effective either. The backhoe operator does not have the direct control of the amount of water applied to the soil, which presents a further obstacle in making it difficult for him to achieve the maximum dry density of the soil being compacted.

During road working, the workers holding the water hoses are, at times, close to the path of on-coming traffic, thus creating yet another added safety issue. An especially hazardous safety issue relates to workers standing on wet slippery ground while watering the soil. The workers are subject to slipping and falling into the path of the backhoe during the soil compacting process, which such accident can cause severe injury and possible fatalities.

SUMMARY

Our new water spray system Invention is designed for the adaptation on all types and sizes of backhoe machines produced in the United States of America and abroad, by the simple retrofitting of the machine. It can also be installed during the production phase of the backhoe machine.

The general object of our Invention is to provide a safe, efficient, cost effective modus, and a better method of applying spray water for compacting soil by the operator of a backhoe machine, militating against the necessity to manually apply water to the soil by workers holding water hoses. With the water spray system incorporated into the backhoe control system, the operator will have full control over how much water is applied to the soil, and when and where to apply water spray to the soil. The system is comprised of a water spray head mounted to the end of the jig boom arm of the backhoe, located just above the vibrating soil compactor, and addressed toward the ground, in direct view of the backhoe operator, to accurately direct and apply the water spray.

Attached to the spray head is a metal conduit supplying water to the spray head; the conduit is mounted and clamped to the jig boom arm and routed along the length of the jig boom arm to its pivot joint. Coupled to the end of the conduit is a flexible rubber hose which is looped to compensate for the bending and pivotal rotational movement of the jig boom.

The other end of the rubber hose is connected to a second metal conduit, thus mounted and clamped to the main boom of the backhoe, and routed to the main boom pivot, located within the well of the backhoe. To compensate for the pivotal movement of the main boom, a second rubber hose is coupled to the end of the metal conduit, looped within the well of the backhoe and routed under the cab to the outlet port of an electrically controlled valve, positioned under the frame of the backhoe drive motor. A third rubber hose routed from the inlet port of the valve is suspended by plastic ties to a support frame, extending rearward of the backhoe and connected to the water supply tank.

A manually operated foot control switch, located in the backhoe cab, opens and closes the electrically operated valve, thus controlling the flow of water from the water supply tank to the spray head located on the jig boom. Thus, the water spray system allows the backhoe operator to have the capability to control the flow of water to the ground surface while still operating the boom arms, and to drive the backhoe to various areas within the designated work zone when compacting the soil.

A related feature is to also provide the backhoe operator with the capability to wet the surrounding working area in order to control harmful soil and concrete dust generated during the hoe-ram operation, which machinery breaks up concrete and asphalt roads, in preparation for paving the way for the laying of new roads.

Prior Art requires workers to manually wet the surface while holding water hoses, placing the workers in danger of getting in the way of the backhoe operator, subjecting them to the possibility of being struck by the backhoe. The Invention of our Backhoe Water Spray System totally eliminates this potential safety hazard.

Objects and Advantages

Accordingly, besides the objectives and advantages of providing the ground watering spray system for the backhoe described in our above patent, several other objectives and advantages of the present invention are:

To provide the backhoe operator full control over the quantity of water administered to the soil being compacted by controlling the water spray from the cab while operating the soil compactor.

To empower the backhoe operator, from his position in the cab, with full control of where the water must be applied to the soil being compacted.

To provide the backhoe operator with full control of the amount of water applied to the soil in order to achieve the maximum dry density required of the compacted soil.

To provide the backhoe operator with the capability of wetting the surrounding working area by using the water spray system to control harmful concrete dust and/or soil dust, which is generated during trench digging and/or excavation of the soil, or simply wetting the ground to hold down dust, blowing as the result of high wind conditions.

To provide the backhoe operator a spray system with the capability of cleaning large areas of ground surfaces with high pressure water, high pressure steam, detergents, biodegradable solvents or the like cleaning liquids.

To provide a safe environment within the 360° radial swing of the backhoe boom arms by eliminating the need for workers to stand around the backhoe, applying water to the ground with hoses, as is the industry's present practice.

To provide a welded frame assembly in the rear of the machine to suspend the water hose high above the ground in order to prevent driving over the hose when the backhoe moves in reverse direction.

To provide a welded frame assembly in the rear of the machine to suspend the water hose high above the ground for the backhoe operator to have a clear and unobstructed view of the hose, to determine the limit at which the backhoe can move forward without over-stretching the water supply hose. The stretching of the hose is gauged by the position of the spring supported horizontal pivot beam, to which the water supply hose is attached. A down angle position of the beam alerts the backhoe operator that the hose is being stretched to its limit.

DRAWINGS FIGURES

In the drawings, which form part of the specification, closely related figures have the same number but different alphabetic suffixes.

REFERENCE NUMERALS IN DRAWINGS

| | |
|---|---|
| 10. Backhoe | 12. Operator |
| 14. Manual application | 16. Water |
| 18. Soil | 20. Vibrator soil compactor attachment |
| 22. Workers | 23. Arm |
| 24. Arm | 26. Pivot |
| 28. Pivot | 30. Cab |
| 32. Backhoe center pivot axis | 34. Motor |
| 36. Water spray system | 38. Spray head |
| 41. Well | 42. Valve |
| 44. Water supply tank | 46. Lever |
| 48. Actuator | 50. Conduit system |
| 52. Pipe | 54. Hole |
| 56. Cap | 58. 90° |
| 60. Conduit | 62. Retainer |
| 64. Bolt | 66. Coupling |
| 68. Tube | 70. Conduit |
| 72. Flexible hose | 74. Outlet port |
| 76. Valve | 78. Frame |
| 80. Inlet port | 82. Hose |
| 83. Hose support ring | 84. Frame |
| 86. Bracket | 87. Pin |
| 88. Square hole | 89. Leg |
| 90. Weld | 98. Clevis |
| 100. Arm | 102. Pin |
| 104. Plate | 106. Holes |
| 108. Spring | 110. Hole |
| 112. Foot | 114. Switch |

-continued

| | |
|---|---|
| 116. Slack | 118. Eagle claw thumb attachment |
| 120. Surface | 122. Rocks |
| 124. Ground subsurface | 126. Contaminated areas |
| 128. Liquid cleaners | |

DESCRIPTION OF INVENTION

FIG. 1—Prior Art

Figure 1:
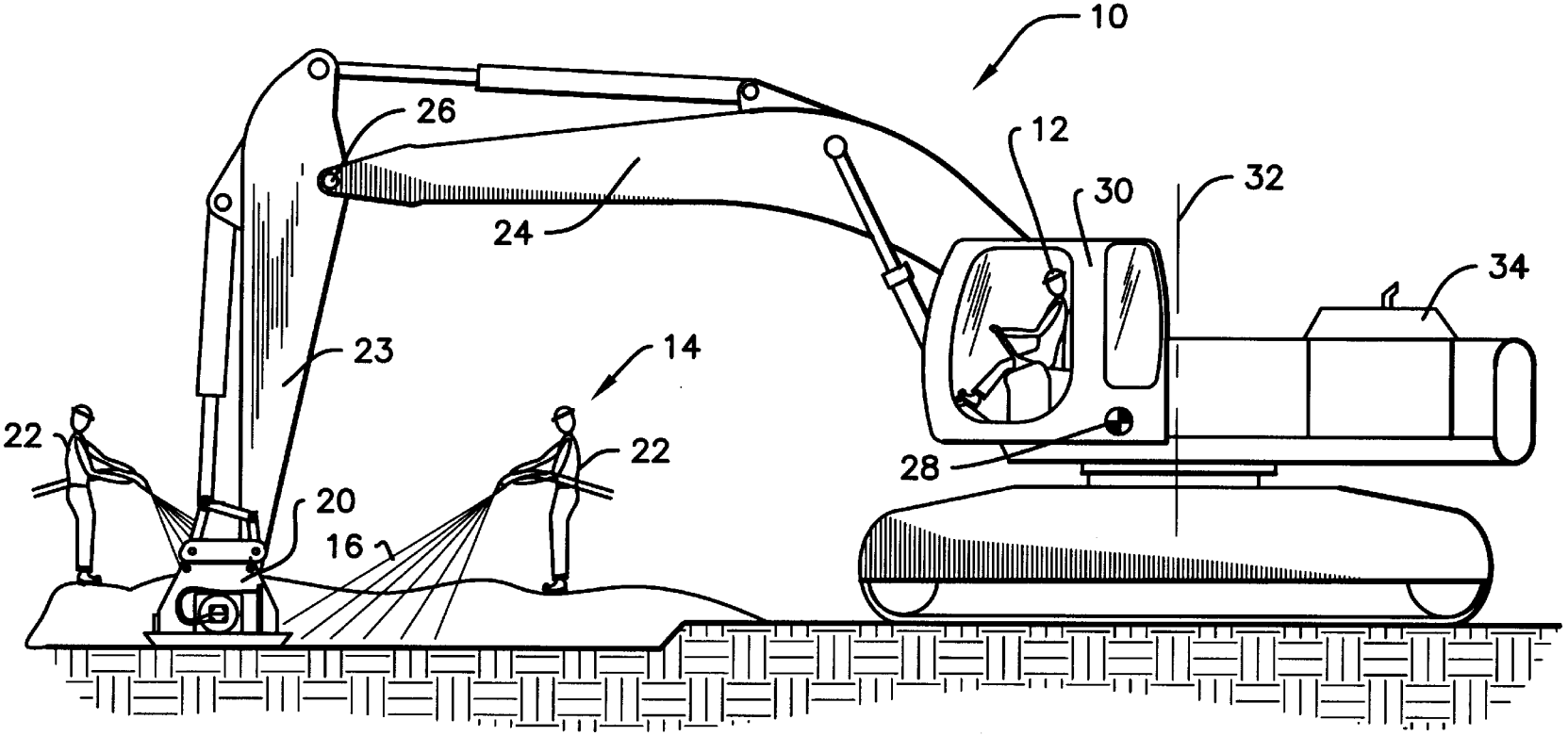
PRIOR ART Fig. 1
FIG. 1 shows an elevation view showing PRIOR ART of the present ground watering hand method used to wet and soften the ground when the backhoe vibratory soil compactor is employed.

With reference to FIG. 1. of the appended drawings, prior art for backhoe 10 operators 12 have long been plagued with problems associated with the manual application 14 of water 16 to the soil 18 when operating the vibratory soil compactor attachment 20.

It is to be noted that the archaic practice of manually applying water 16 to soften the soil 18 to meet today's compact earth density regulations in preparing the way for new roads, building foundations, parking lots, and various construction needs where compaction of the soil 18 is a fundamental requirement, has long been, and continues to be, a safety hazard to the workers 22, who must water the soil while in harm's way, when the backhoe 10 machine is in full operation.

The backhoe 10 has the capability of extending the jig boom arm 23 and the main boom arm 24 about pivot joints 26 and 28, respectively, as well as rotating the arm 360° degrees about the cab 30 center pivot line 32, thus sweeping through a large radius of the working area. During this operation, the backhoe operator 12 will lose visual contact with workers 22, hence requiring strict safety measures to prevent potential harm to the workers 22 positioned in the work area.

Because of the excessively loud, deafening noise generated by the backhoe motor 34, hand signals must be used by the operator 12 to direct the workers 22 where best to apply water 16 to the soil 18. This method not only distracts the operator 12, it also hinders the operator 12 from precisely controlling the quantity of water 16 needed to be applied to the soil 18 in order to achieve the correct soil compaction density requirements.

Our Invention not only solves these persisting problems, but also solves the dust control problems at the work site by providing the operator 12 with the means to independently spray water 16 where it is needed, making redundant any assistance from workers 22 to manually spray the work area.

Our Invention also provides a means of cleaning large ground surfaces areas with a loan operator of the backhoe machine, using our spray system attachment, with high pressure water, high pressure steam, biodegradable detergents, and solvents or the like cleaning liquids. As a result, oil spills, accidents on city streets, coastal shores such as the Valdez oil spill disaster on Alaska coastal shores, and the like accidents occurring all over the world, can be dealt with in a way far more efficient and cost effective then the prior art.

Figure 2:
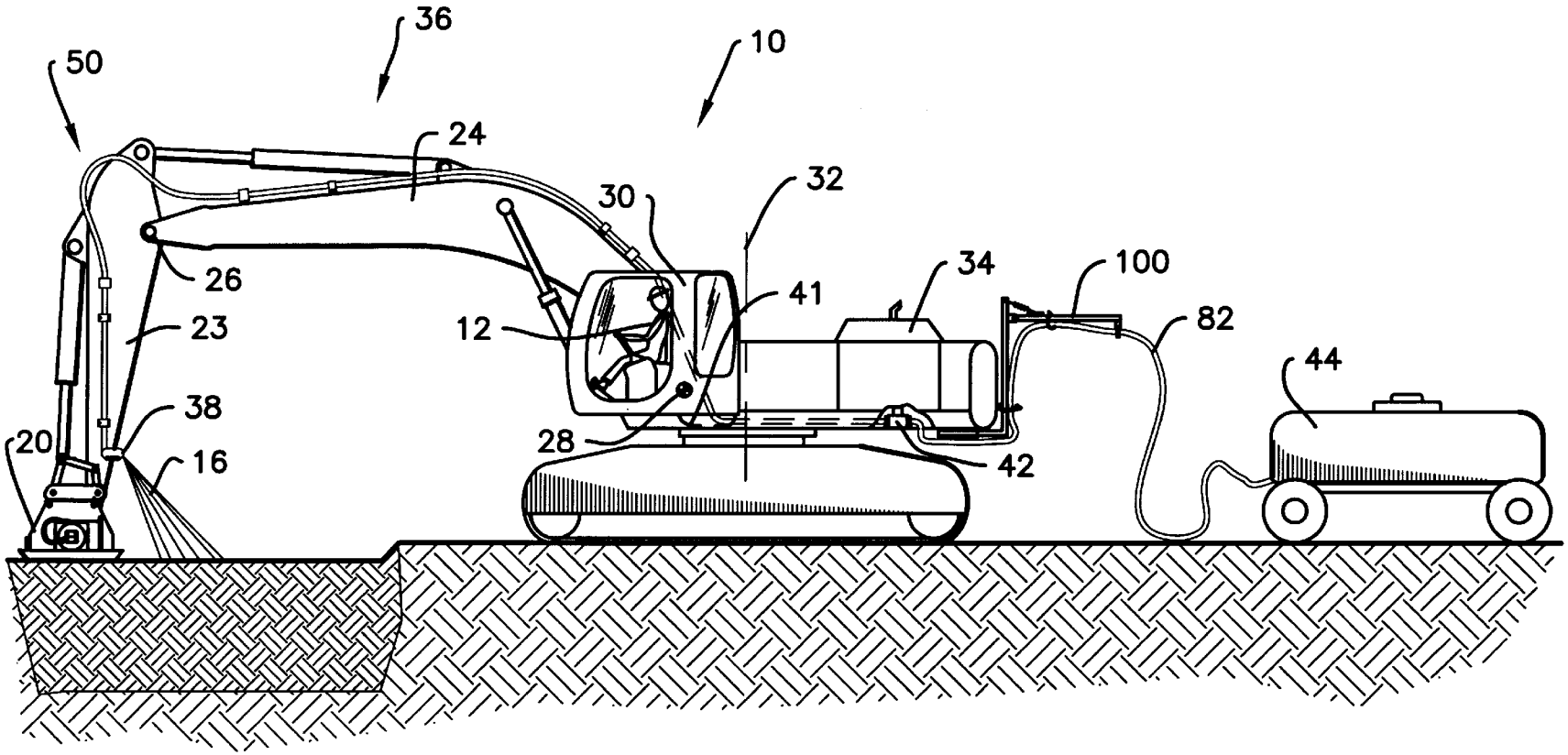
FIG. 2 shows an elevation view of our Invention, The Ground Watering Spray System installed on a backhoe machine.

FIG. 2—Preferred Embodiment

A preferred embodiment of our invention as illustrated in FIG. 2 resolves the problems which have plagued backhoe operators 12 from the beginning.

The water spray system 36 for a backhoe 10 is designed to provide the backhoe operator 12 with the means to independently control the application of spray water 16 onto the soil 18 from the position of the cab 30, while still manipulating the control levers 13 to operate the backhoe 10, jig boom 23, and the main boom 24. Water spray 16 is applied to the soil 18 being compacted through a water spray head 38 secured to the jig boom 21, and it is located just above the vibratory soil compactor attachment 20. The primary importance of this feature is to provide the operator 12 full visual sighting of the water 16 spray being applied to the soil 18.

Water 16 to the spray head 38 is supplied through a conduit system 50 which is secured to the jig-boom 23, and the main-boom 24. The conduit 50 continues through, and into the backhoe well 41, under the cab 30, to an electrically operated control valve 42 connected to a pressurized trailer which is mounted on the main water supply tank 44, thus providing water 16 to the water spray head 38.

Optional methods of supplying water 16 to the water head 38 is the use of water pumping means from various water storage sites such as large water tanks, water storage ponds, and pressurized water systems. In addition, a water storage tank will be mounted on top of the backhoe 10, above the engine 34, as a means of supplying water to the water spray head 38. The water tanks will also be used as counter weights during backhoe operation. Counter weights are occasionally used on backhoe machines to gain traction, and water storage tanks mounted on top of the backhoe 10, above the engine 34, will be used to replace the counter weights.

Backhoe 10 machines, or the like equipment, as shown in FIG. 1, which are presently in the field, may be retrofitted with a water spray system 36, as shown in preferred embodiment of FIG. 2, irrespective of their size or brand name, and regardless of whether it is manufactured in the United States or abroad. Furthermore, the water spray system 36 is adaptable to all present on-line production assembly of new and future backhoe 10, or the like machines.

Figure 3:
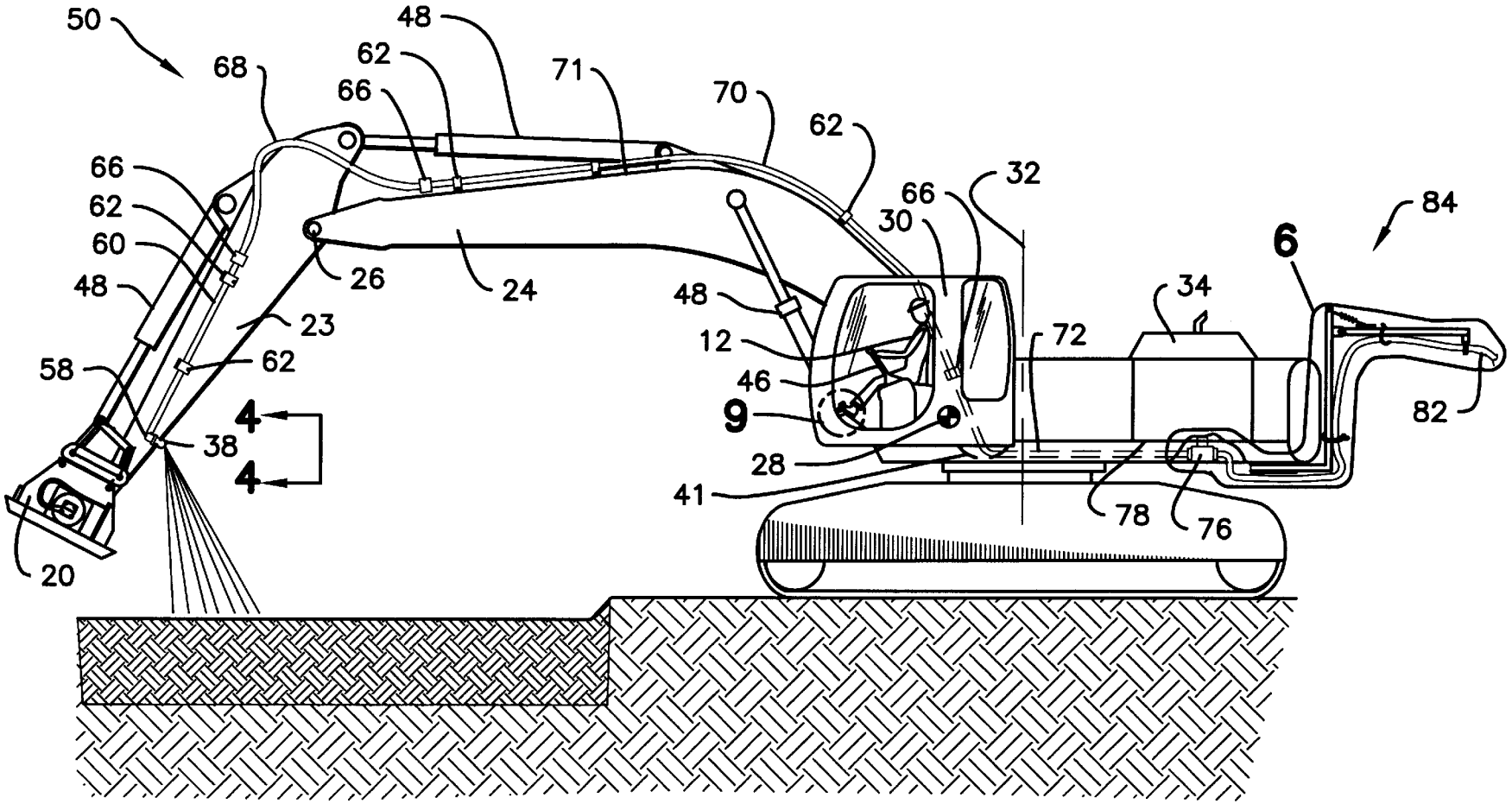
FIG. 3 shows an elevation view, showing the Watering Spray System raised above the ground.
Figure 4:
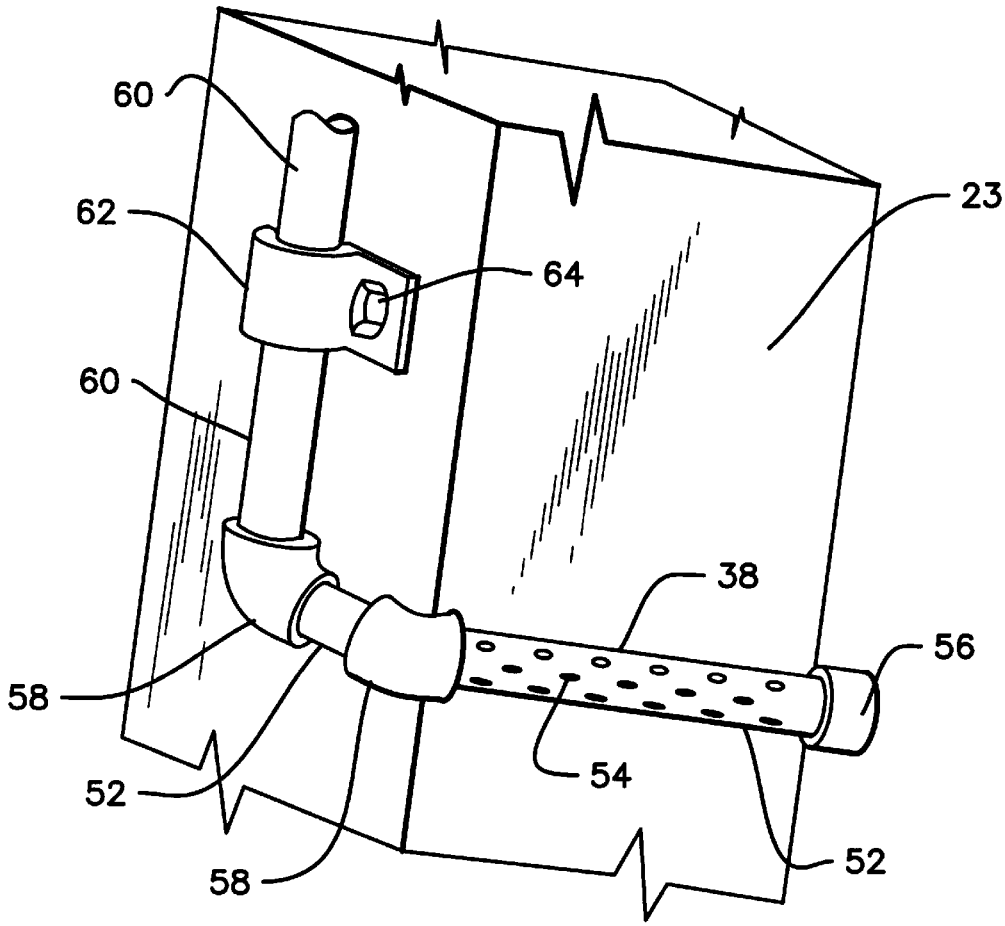
FIG. 4 shows an enlarged diagrammatic perspective view of the water spray head.
Figure 5:
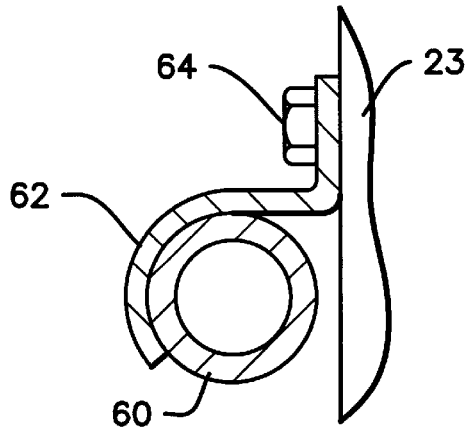
FIG. 5 shows an enlarged view of the water conduit attachment and clamping means.

FIGS. 3–4–5—Additional Embodiments

With reference to FIG. 3 of the appended drawings, it shows the boom arms 23 and 24 raised above the ground spraying water 16 onto the soil 18. The manipulation of these boom arms 23 and 24 are controlled by the operator 12 using control levers 46 by retracting or extending linear hydraulic actuators 48, which rotate the boom arms 23 and 24 on pivot pins 26 and 28, thus permitting the conduit system 50 to flex at these pivot pin joints 26 and 28.

With reference to FIG. 3 , now directed to the conduit system 50, the spray head 38, shown in an enlarged view in FIG. 4, is comprised of a steel pipe 52 threaded at both ends with a plurality of spaced holes 54, a steel threaded cap 56, a series of threaded 90° degree elbows 58, threaded to a steel conduit 60. FIG. 5, an enlarged view, is comprised of the conduit 60, which is attached by means of steel retainers 62, with bolt 64 threaded into the jib boom arm 23.

With reference again to FIG. 3, the spray head 38 is fixed in its position by the ridged arrangement of the steel conduit 60 bolted to the jig boom arm 23. The threaded spray head 38 is removable and is designed to be replaced with spray head arrangements of various spray patterns, such as wide angle, round, flat vertical and flat horizontal patterns. These spray patterns are used to accommodate the terrain and soil compact requirements.

Referencing FIG. 3 again, secured to the other end of the steel conduit 60 is a pipe coupling 66 connected to a looped flexible rubber hose 68. At this pivotal position, the flexibility of this rubber hose 68 allows the free bending of the conduit system 40, which is the natural result of the continued manipulation of the boom arms 23 and 24 during the backhoe 10 operation. Coupled to the other end of the rubber hose 68 is a longer steel conduit 70 secured to the main boom arm 24 with bolted steel retainers 62.

This longer steel conduit 70 runs along the top surface 71 of the main boom arm 24 into the conduit well 41 which is positioned above the main boom arm pivot joint 28 and terminates at a pipe coupling 66 connected to a second flexible rubber hose 72, which runs under the cab 30, connects into the outlet port 74 of an electrically operated water control valve 76, and is positioned below the backhoe 10 motor 34 frame structure 78, which is also shown as a view in FIGS. 6 and 7. The flexible rubber hose 72 is positioned to allow the free bending of the conduit system 50 at the pivotal position of the main boom arm pivot 28, and the free routing of the rubber hose 72 under the motor frame 78 to the valve 76 outlet port 74.

Figure 6:
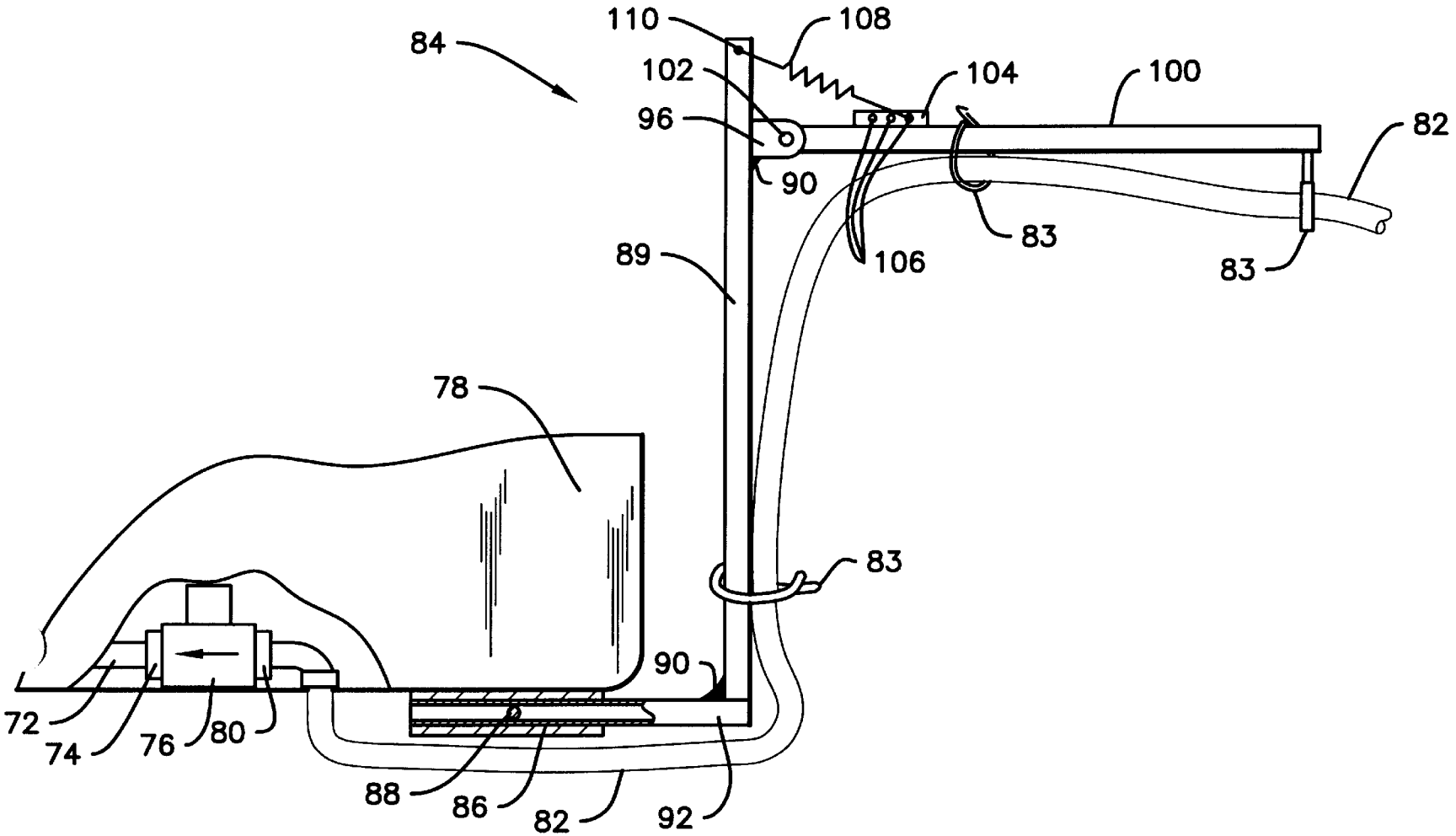
FIG. 6 shows an enlarged view of the of the water conduit supporting means.

FIG. 6—Additional Embodiments

As can best seen in FIG. 6 and FIG. 2, connected to the inlet port 80 of the valve 76, a rubber hose 82 extends from the rear of the backhoe 10 through a series of loosely guided rings 83, which are supported by frame 84, extending to the main water supply tank 44.

Figure 7:
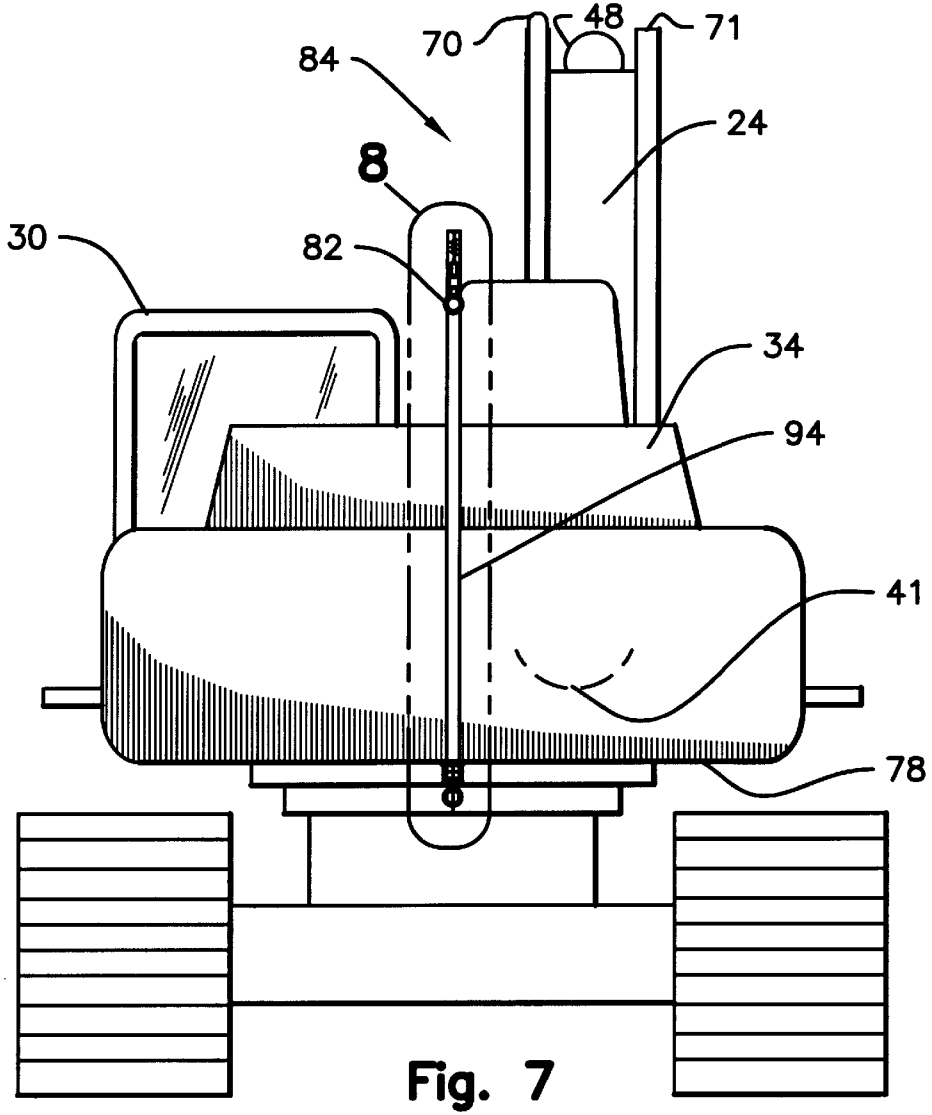
FIG. 7 shows a rear view of the backhoe machine showing the conduit supporting means.

FIG. 7—Additional Embodiments

Figure 8:
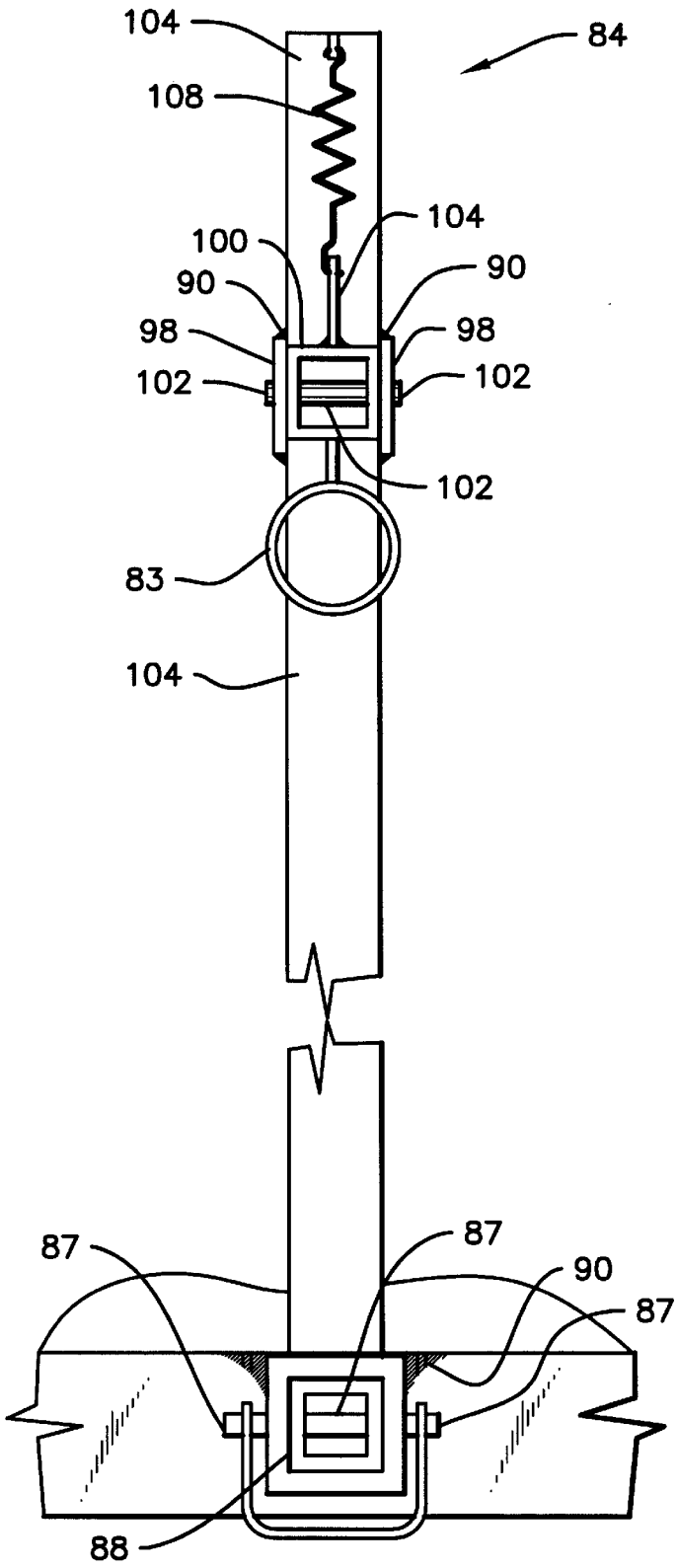
FIG. 8 shows an enlarged view of the hose supporting means shown in FIG. 7.

As best seen in FIG. 7, the frame 84 assembly is positioned at the center of the backhoe 10 in the rear, and supported by bracket 86. The bracket 86 is an extruded hollow square steel pipe with a square hole 88, and is attached to the motor frame structure 78, by welds 90 which are best seen in FIG. 8. The frame 84 horizontal leg 85 is an extruded hollow square steel pipe which slides into the square hole 88 of bracket 86 and is secured with pin 87.

FIGS. 6–7–8—Additional Embodiments

Best shown in FIGS. 6, 7 and 8, is the welded frame 84 assembly. The frame 84 is purposely designed to be raised above the motor 34 for the backhoe operator 12 to have a clear and unobstructed view in order to prevent the over-stretching of the hose 82, by the operator's being able to clearly see the pivotal deflection of the frame arm 100 from the cab 30. In addition, the frame 84 is purposely designed to extend beyond the rear of the backhoe 10 to raise the hose 82 above the ground, and to prevent the backhoe 10 from running over and damaging the hose 82 when the backhoe 10 moves in reverse. As the backhoe 10 moves in reverse gear, the hose 82 is held high above the ground level by the support ring 83 attached to the frame arm 100, thus preventing entanglement between the hose 82 and the backhoe 10 track The welded frame 84 assembly consists of a horizontal leg 85, and a vertical leg 89, attached by weld 90. A bracket 96 is welded to the side walls of the vertical leg 89, thus forming a clevis 98 arrangement best shown in FIG. 8, to which an arm 100, made from square steel pipe, is attached with pin 102, thus allowing the arm 100 to pivot on the pin 102. Welded to the pivot arm 100 is a flat steel plate 104 with a series of drilled holes 106 to which a steel tension spring 108 is attached, the ends of which are attached to a hole 110 at the top of the vertical member 89, and to one of the holes 106 in plate 104, all serving to balance the weight of the rubber hose 82 against the spring 108 tension force in order to maintain the arm 100 in the horizontal position.

FIGS. 3–9–10 and 11—Additional Embodiments

Figure 11:
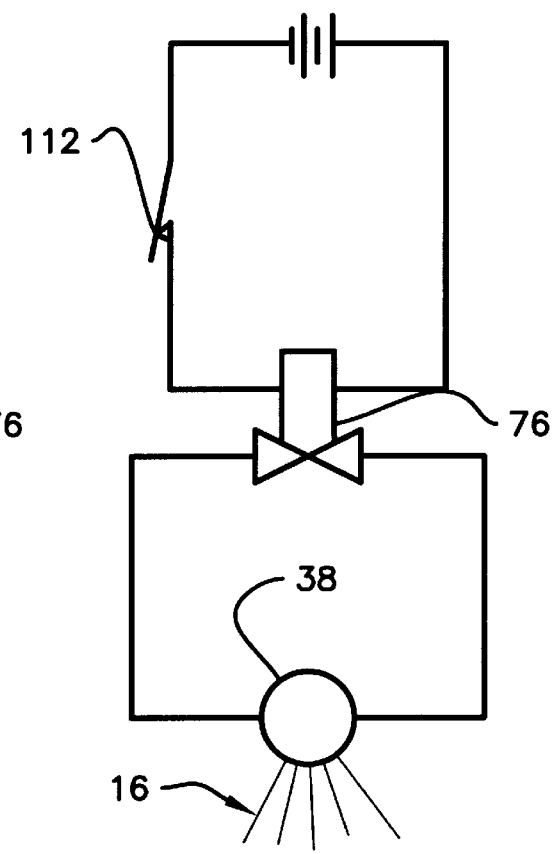
FIG. 11 shows an electric schematic showing the electric control valve energized.
Figure 10:
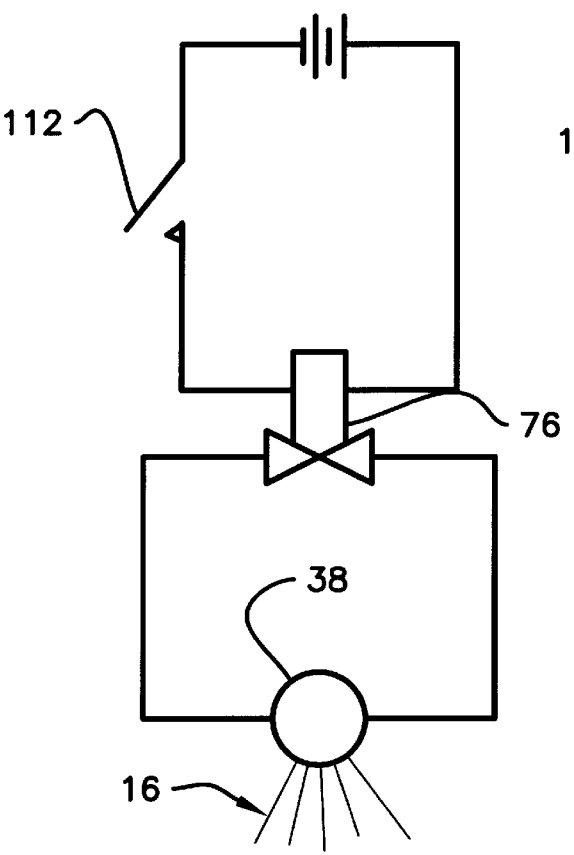
FIG. 10 shows an electric schematic showing the electrical control valve de-energized.
Figure 9:
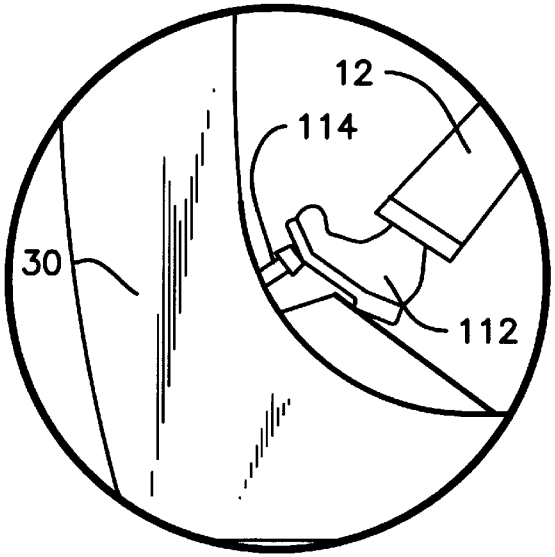
FIG. 9 shows an enlarged view of the operator's foot control protuberance for administering water spray to the ground working area.

As best seen in FIGS. 3, 9, 10 and 11, the backhoe operator 12 controls the water spray system 36 while still operating the control levers 13 of the backhoe 10. This maneuver is accomplished by using his/her foot 112 to depress an electrical switch 114 which energizes the electric valve 76, causing it to open, initiating the water spray 16 at the spray head 38. By raising the foot pedal 114 off the switch 112, the electric valve 76 is de-energized, thus closing the electric valve 76, and shutting off the water spray 16 at the spray head 38. FIG. 10 is a schematic showing the valve de-energized, and FIG. 11 is a schematic showing the valve energized.

Figure 12:
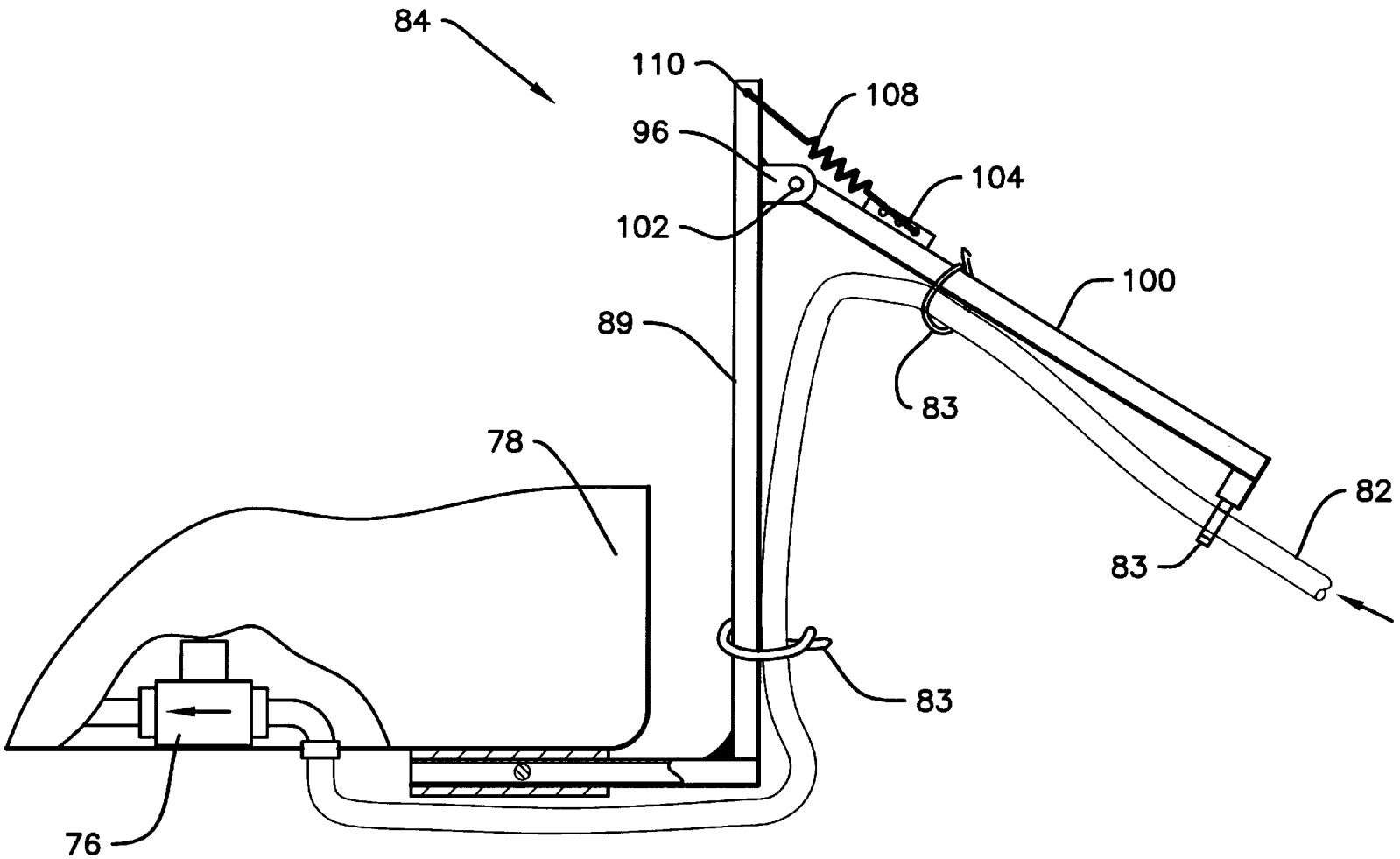
FIG. 12 shows an enlarged view of the water conduit tension relief means.

FIG. 12—Additional Embodiments

FIG. 12 shows the pivot arm 100 in the downwardly position to relieve the tension on the rubber hose 82 resulting from the back and forth movement of the backhoe 10 during its operation. Although the hose 82 is provided with sufficient slack 116 at the onset of the operation, the pivot arm 100 provides a safety margin to prevent potential rupturing of the hose as the backhoe moves forward. As the slack 116 in the rubber hose 82 diminishes as the result of the forward motion of the backhoe, the water tank 44 is manually pushed into a new position which will maintain the slack 116 in the hose 82.

Figure 13:
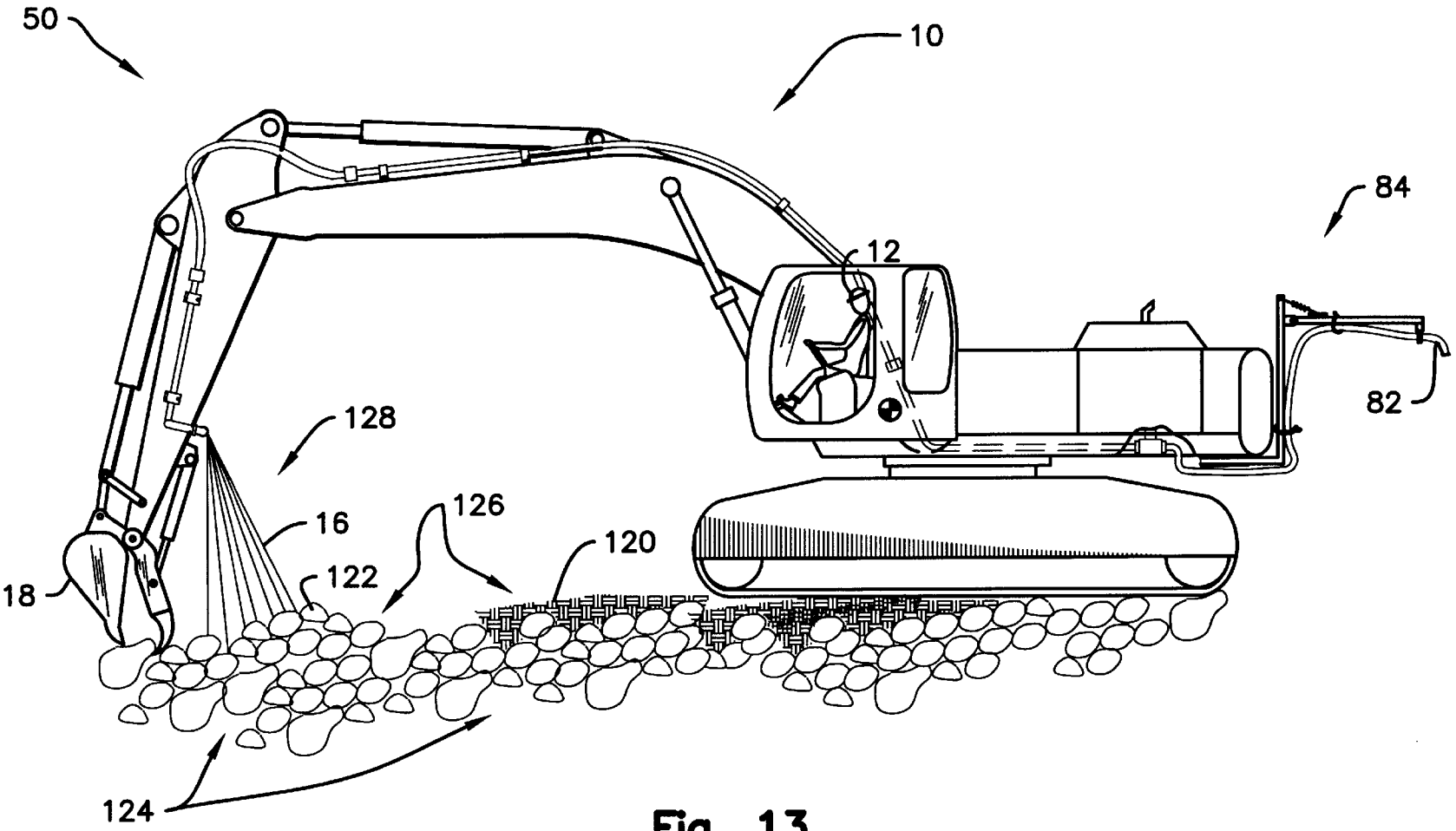
FIG. 13 shows an elevation view of our invention, with an eagle claw thumb attached to the backhoe boom arm for surfaces cleaning purposes.

FIG. 13—Additional Embodiments

The embodiment of our invention shown in FIG. 13 resolves the problem of using manual labor for cleaning ground surfaces contaminated with oil spills, gasoline spills, acid spills and the like toxic compounds as a result of accidents. The backhoe conduit system 50 allows a single backhoe operator 12 to clean the surfaces 120 with liquid cleaners 128 such as high pressure water, high pressure steam, biodegradable detergents, solvents or the like liquids with a spray 16. These liquid cleaners 128 will be supplied from a storage tank 44 as depicted in FIG. 2. The use of an eagle claw thumb 118 attached to the boom arm 23 of the backhoe 10 is used to turn over rocks 122, for cleaning under the rocks 122 and ground 124 subsurface as the operator 12 is spraying 16 and cleaning the contaminated area 126. The use of the backhoe 10 to clean contaminated areas provides safety for workers 22 by eliminating the need for workers 22 from being in direct contact with the contaminates, and the cleaning fluids 128.

CONCLUSION, RAMIFICATION, AND SCOPE

While a preferred form of the invention has been shown in the drawings and described, since variations in the preferred form will be apparent to those skilled in the art, the invention should not be construed as limited to the specific form shown and described, but instead is as set forth in the following claims.

We claim:

1. A ground watering spray system for backhoe machines comprising:

a spray head;

a valve;

a flexible conduit line; and a metal support frame;

said frame consisting of a downward pivoting horizontal bar hinged at one end about a pivot pin welded to a vertical post;

wherein said downward pivoting horizontal bar is adapted to protrude outwardly from the rear of a backhoe machine suspending said flexible conduit line above the ground for prevention of entanglement of said flexible conduit line while the backhoe machine is in operation.

2. The ground watering spray system of claim 1, wherein the spray head is removable.

3. The ground watering spray system of claim 2, wherein the spray head includes a plurality of apertures spaced in staggered rows along the under length of said spray head for dispensing water in a spray pattern on a ground surface.

4. The ground watering spray system of claim 3, wherein the apertures are circular holes, each said circular hole having a diameter less than 0.5 inch.

5. The ground watering spray system of claim 1, wherein the valve is electrically operated from a remote manual switch between an open position and a closed position for controlling the flow of liquid to said spray head.

6. The ground watering spray system of claim 1, wherein said flexible conduit line comprises rubber material.

7. The ground watering spray system of claim 6, wherein said flexible conduit line is adapted to compensate for pivoting action between the arm and boom of a backhoe machine.

8. The ground watering system of claim 6 in combination with a backhoe machine, wherein said flexible conduit line is positioned at the main boom and arm of the backhoe.

9. The ground watering system of claim 6 in combination with a backhoe machine, wherein said flexible conduit line is positioned at the pivot joint of the main boom in the backhoe well.

10. The ground watering spray system of claim 1 in combination with a backhoe machine, wherein said support frame is mounted to a support bracket, said support bracket attached to the rear center of the backhoe.

11. The ground watering spray system of claim 1, wherein said support frame is removable.

12. The ground watering spray system of claim 1, wherein said support frame supports a liquid supply hose with hose support rings.

13. The ground watering spray system of claim 1 in combination with a backhoe machine, wherein said support frame extends upwardly above the motor of the backhoe thereby providing an indicium marker of the flexible conduit line from the backhoe cab.

14. The ground watering spray system of claim 1, further including a portable tank, wherein said system is used to clean ground surfaces contaminated with hazardous materials including oil spills, gasoline, and acids.

* * * * *